US007627273B2

(12) United States Patent
Tanabe

(10) Patent No.: US 7,627,273 B2
(45) Date of Patent: Dec. 1, 2009

(54) DEVELOPING UNIT

(75) Inventor: Kenichi Tanabe, Aomori (JP)

(73) Assignee: Kyocera Mita Corporation, Osaka (JP)

( * ) Notice: Subject to any disclaimer, the term of this patent is extended or adjusted under 35 U.S.C. 154(b) by 702 days.

(21) Appl. No.: 11/468,289

(22) Filed: Aug. 29, 2006

(65) Prior Publication Data

US 2007/0048026 A1 Mar. 1, 2007

(30) Foreign Application Priority Data

Aug. 31, 2005 (JP) ..... 2005-252487
Aug. 31, 2005 (JP) ..... 2005-252488

(51) Int. Cl.
*G03G 15/08* (2006.01)

(52) U.S. Cl. ..... 399/258; 399/227

(58) Field of Classification Search ..... 399/227, 399/258

See application file for complete search history.

(56) References Cited

U.S. PATENT DOCUMENTS 7,274,899 B2 * 9/2007 Tomoe ..... 399/227

FOREIGN PATENT DOCUMENTS

JP 10-198149 A 7/1998

* cited by examiner

*Primary Examiner*—David M Gary
*Assistant Examiner*—Bryan P Ready
(74) *Attorney, Agent, or Firm*—Frommer Lawrence & Haug LLP

(57) ABSTRACT

A developing unit is provided with developers, toner supply pipes, a drive mechanism, a position holding mechanism, and a retraction mechanism. Each of the plurality of developers has a development roller that corresponds to a color. Each toner supply pipe has a toner supply port and supplies toner to one of the plurality of developers. The drive mechanism moves the toner supply pipes so that each toner supply pipe can be positioned at a toner supply position and a retraction position. The position holding mechanism restricts the movement of the toner supply pipes so that one of the toner supply pipes is positioned at the toner supply position. If the electric power is cut off such that one of the toner supply pipes is positioned at the toner supply position, then the retraction mechanism releases the restriction of movement of that toner supply pipe and positions that toner supply pipe at the retraction position.

12 Claims, 15 Drawing Sheets

(a)

(b)

(a)

(b)

(a)

(b)

DEVELOPING UNIT

CROSS-REFERENCE TO RELATED APPLICATIONS

This application claims priority to Japanese Patent Application Nos. 2005-252487 and 2005-252488. The entire disclosure of Japanese Patent Application Nos. 2005-252487 and 2005-252488 are hereby incorporated herein by reference.

BACKGROUND OF THE INVENTION

1. Field of the Invention

The present invention relates to a developing unit, and more particularly to a developing unit which is used in a color image forming device to which toner is externally supplied.

2. Background Information

Image forming devices that use an electrophotographic system are provided with, for example, a charging unit, an exposure unit, a developing device, a transfer device, and a cleaning device at the circumference of a photoreceptor drum (an image carrier). In addition, a fusing device is provided on the downstream side of the photoreceptor drum in the transfer material transport direction. First, with such an image forming device, the charging unit uniformly charges the surface of the photoreceptor drum. Subsequently, the exposure unit exposes the photoreceptor drum based on image data, and thereby forms an electrostatic latent image on the photoreceptor drum surface. The developing device then develops the electrostatic latent image.

If the image forming device is a full color type, then four developers are provided that respectively contain a cyan, a magenta, a yellow, and a black developing agent, which develop those four colors of the toner image. Subsequently, the developed toner image is transferred by the transfer device onto a transfer material and then fused by the fusing device, after which the transfer material is discharged to a discharge unit. The cleaning means cleans the residual developing agent on the photoreceptor drum.

The development of the toner in such an image forming process consumes the toner contained in the developers, making it necessary to supply toner. One method of supplying toner consumed by image formation is to externally supply toner by providing a toner container that is external to the developers, as disclosed in Japanese Published Unexamined Patent Application No. H10-198149. In this publication, toner is supplied to a plurality of developing devices by inserting a toner supply member into the developing device of each toner color to be supplied.

With a device of a type that supplies toner by inserting a toner supply member into a developing device as disclosed in Japanese Published Unexamined Patent Application No. H10-198149, if the device transitions to an electric power cutoff state during the toner supply operation, then the operation of the developing device will stop in a state wherein the toner supply member is inserted in a developing device. When the supply of power subsequently resumes, there is a risk that the state wherein the toner supply member is inserted into the developing device will not be recognized and, in such a state, the developing device will rotate in order to initialize. In such a case, there is a possibility that the toner supply member or the developing device will break.

An object of the present invention is to prevent breakage of the toner supply member and the developing device when the supply of power resumes, even if electric power was cut off in a state wherein the toner supply member was inserted in the developing device.

In view of the above, it will be apparent to those skilled in the art from this disclosure that there exists a need to prevent breakage of the toner supply member and the developing device when the supply of power resumes, even if electric power is cut off in a state wherein the toner supply member was inserted in the developing device. This invention addresses this need in the art as well as other needs, which will become apparent to those skilled in the art from this disclosure.

SUMMARY OF THE INVENTION

A developing unit according to a first aspect of the invention comprises container main bodies, toner supply members, a drive mechanism, a position holding mechanism, and a retraction mechanism. The plurality of container main bodies each comprises a development roller. The plurality of toner supply members each comprises a toner supply port and supplies toner to each of the plurality of container main bodies. The drive mechanism is for moving the toner supply members so that each toner supply member can be positioned at a toner supply position, wherein the toner supply port is positioned inside the container main body, and at a retraction position, wherein the toner supply member is positioned outside the container main body. The position holding mechanism restricts the movement of each toner supply member in a state wherein the toner supply member is positioned at the toner supply position. The retraction mechanism releases the position holding mechanism's restriction of movement of the toner supply member and positions the toner supply member at the retraction position when the electric power is cut off in a state wherein the toner supply member is positioned at the toner supply position.

When supplying toner with this developing unit, the drive mechanism moves one of the toner supply members to the toner supply position, and the toner is supplied from the toner supply member to the container main body. In the state wherein the toner supply member is positioned at the toner supply position, the movement of the toner supply member is restricted by the position holding mechanism. Furthermore, if the electric power is cut off in the state wherein the toner supply member is positioned at the toner supply position, the retraction mechanism releases the position holding mechanism's movement restriction of the toner supply member, and the toner supply member moves to the retraction position.

At this point, if the power transitions to the electric power cutoff state when supplying toner, then the toner supply member is retracted to the retraction position, and it is therefore possible to reduce the risk of breakage of the toner supply member and the developing device attendant with the rotation of the developing device in order to perform initialization when the power supply resumes.

A developing unit according to a second aspect of the invention is a developing unit as recited in the first aspect of the invention, wherein the position holding mechanism comprises a first latching unit fixed to each toner supply member, and a second latching member which latches to the first latching unit.

With this developing unit, if the toner supply member is positioned at the toner supply position, the first latching unit fixed to the toner supply member latches with the second latching member latch. Attendant therewith, the movement of the first latching unit is restricted, and the position of the toner supply member is consequently held at the toner supply position.

A developing unit according to a third aspect of the invention is a developing unit as recited in the first aspect of the invention, wherein the retraction mechanism comprises a second latching member drive device, which moves the second latching member so that the latching of the first latching unit and the second latching member is released, and an urging member, which urges the toner supply member so that it is positioned at the retraction position.

With this developing unit, if the power transitions to the electric power cutoff state while supplying toner, the second latching member drive device moves the second latching member so as to release the latching of the first latching unit and the second latching member. As a result, the toner supply member can move. The urging member urges the toner supply member so that it moves to the retraction position.

A developing unit according to a fourth aspect of the invention is a developing unit as recited in the second aspect of the invention, wherein the position holding mechanism further comprises a member for moving the second latching member, which moves the second latching member so that the first latching unit latches to the second latching member.

With this developing unit, the member for moving the second latching member moves the second latching member so that the first latching unit latches to the second latching member, thereby latching the first latching unit and the second latching member to one another.

A developing unit according to a fifth aspect of the invention is a developing unit as recited in the third aspect of the invention, wherein the second latching member drive device is an urging member.

A developing unit according to a sixth aspect of the invention is a developing unit as recited in the first aspect of the invention, wherein each of the plurality of toner supply members comprises a toner transport member that transports the toner to the toner supply port. Furthermore, the developing unit further comprises an actuation mechanism, which comprises one drive source, that actuates the toner transport member of the toner supply member by the drive source when the toner supply member is positioned at the toner supply position.

With this developing unit, the actuation mechanism of the toner transport member actuates the toner transport member, thereby transporting the toner to the toner supply port and supplies the toner to the container main body.

Here, it is possible to drive the toner transport member of each of the plurality of toner supply members by one drive source, and it is consequently possible to reduce the number of drive sources and the number of members that transmit the drive power of the drive sources, as well as to constitute the device compactly and at low cost.

A developing unit according to a seventh aspect of the invention is a developing unit as recited in the sixth aspect of the invention, wherein the actuation mechanism comprises: one drive source; a member to be driven that is mounted to the toner transport member; and a drive member that transmits drive power to the member to be driven when the toner supply member is positioned at the toner supply position.

With this developing unit, when the toner supply member is positioned at the toner supply position, the drive power of the drive source is transmitted to the member to be driven via the drive member, and the toner transport member is actuated together with the member to be driven.

A developing unit according to an eighth aspect of the invention is a developing unit as recited in the sixth aspect of the invention, wherein the member to be driven is a first disc shaped member; and the drive member is a second disc shaped member that engages with the first disc shaped member.

With this developing unit, the motive power from the drive source rotates the second disc shaped member, and the first disc shaped member, which engages with the second disc shaped member, rotates attendant therewith. Furthermore, the first disc shaped member and the second disc shaped member include, for example, a gear or a friction engageable disk shaped member.

A developing unit according to a ninth aspect of the invention is a developing unit as recited in the eighth aspect of the invention, wherein the first disc shaped member is a first bevel gear; and the second disc shaped member is a second bevel gear.

With this developing unit, the motive power of the drive source is transmitted to the toner transport member via the second bevel gear and the first bevel gear.

A developing unit according to a tenth aspect of the invention is a developing unit as recited in the ninth aspect of the invention, wherein the first bevel gear is supported by the toner supply member so that it is freely movable in the direction of movement of the toner supply device; and the actuation mechanism further comprises an urging member, which urges the first bevel gear to the second bevel gear side.

With this developing unit, the actuation mechanism of the toner transport member meshes the first bevel gear and the second bevel gear, which transmits the motive power from the drive source to the toner transport member. At this time, the drive device moves the toner supply member from the retraction position to the toner supply position. However, when moving the toner supply member from the retraction position to the toner supply position, it is conceivable that the first bevel gear and the second bevel gear will not smoothly mesh. In such a case, the first bevel gear is freely movable and is therefore pushed upward to the retraction position side by the second bevel gear. In this state, the urging member urges the first bevel gear to the second bevel gear side. Subsequently, when the drive source rotates the second bevel gear and it becomes possible for the first bevel gear and the second bevel gear to mesh with one another, the first bevel gear and the second bevel gear mesh with one another.

A developing unit according to an eleventh aspect of the invention is a developing unit as recited in the first aspect of the invention, further comprising: a shutter mechanism that sets the toner supply port to an open state when the toner supply member is positioned at the toner supply position, and sets the toner supply port to a closed state when the toner supply member is positioned at the retraction position.

With this developing unit, when the toner supply member is positioned at the toner supply position, the toner supply port transitions to the open state and toner is supplied from the toner supply device to the container main body; further, when the toner supply member is positioned at the retraction position, the toner supply port transitions to the closed state, and the toner consequently can no longer leak out easily.

A developing unit according to a twelfth aspect of the invention is a developing unit as recited in the first aspect of the invention, wherein the container main body comprises an elastic member that has a slit through which the toner supply member passes when the toner supply member moves to the retraction position and the toner supply position.

With this developing unit, when supplying toner, the toner supply member passes through the slit of the elastic member of the container main body, enters the container main body, and supplies the toner. In addition, when the supply of toner ends, the drive mechanism retracts the toner supply member to the retraction position. At that time, the elastic member having the slit is tightly sealed by its elastic force, and the toner consequently does not leak out.

Here, the elastic member having the slit is disposed at the portion of the developing device where the toner supply member enters it. With such a developing device, if the power enters the electric power cutoff state when supplying toner, there is a possibility that the toner supply member will be left inserted in the developing device for a long period of time. If the toner supply member is left inserted in the developing device for a long period of time, the elastic member will harden with the toner supply member left inserted in the slit, and it is consequently conceivable that it will become difficult for the slit to transition to a close contact state even when the toner supply member moves to the retraction position. Thus, unless the slit of the elastic member transitions to the close contact state, the toner inside the developing device will unfortunately leak out attendant with the rotation of the developing device. However, according to the present aspect of the invention, even if the power transitions to the electric power cutoff state while toner is being supplied, the retraction mechanism releases the position holding mechanism' movement restriction of the toner supply member, and moves the toner supply member to the retraction position, and it is consequently possible to prevent the state wherein the toner supply member is left inserted in the developing device from continuing for a long time period.

With the present invention, it is possible to reduce the risk of breakage of the toner supply member and the developing device even if the power transitions to a motive power cutoff state during the supply of toner and the developing device subsequently rotates. In addition, even if a shutter mechanism on the container main body side comprises an elastic member in which a slit is formed, it is possible to prevent the hardening of the elastic member when the toner supply member is left inserted in the slit of the elastic member, and to prevent the leakage of toner.

These and other objects, features, aspects and advantages of the present invention will become apparent to those skilled in the art from the following detailed description, which, taken in conjunction with the annexed drawings, discloses a preferred embodiment of the present invention.

DETAILED DESCRIPTION OF THE PREFERRED EMBODIMENTS

First Embodiment

Figure 1:
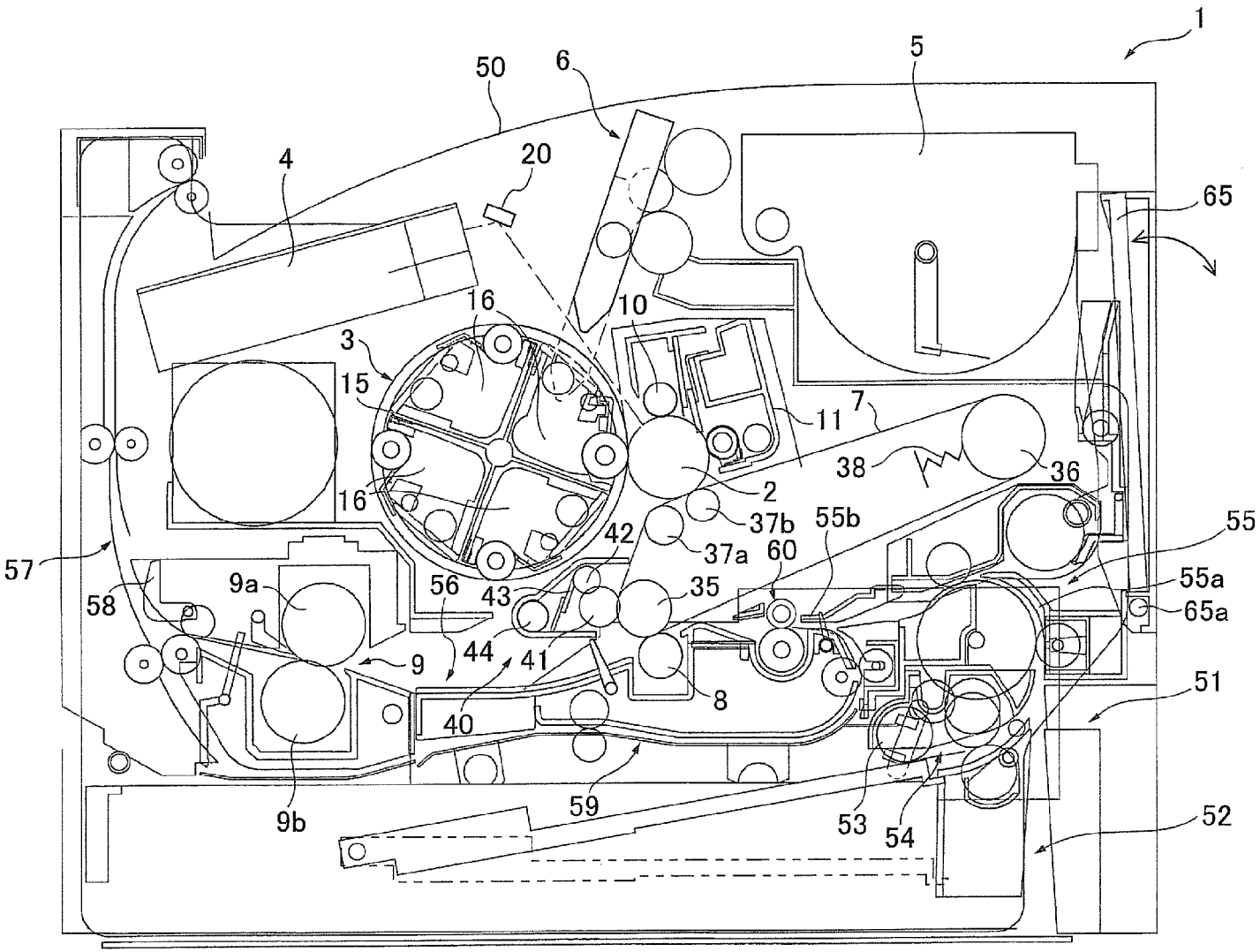
FIG. 1 is a schematic block diagram of a color printer according to one embodiment of the present invention.

FIG. 1 shows a color printer 1, which serves as a full color image forming device, according to one embodiment of the present invention. Furthermore, FIG. 1 is a schematic drawing for the purpose of showing the arrangement of each of the constituent elements, and does not illustrate the details of each unit.

Overall Constitution

The color printer 1 is a device that is connected to, for example, a computer (not shown), and is capable of printing a color image on a sheet of paper based on image data, which is sent from, for example, the computer. In addition, the right side in FIG. 1 is the side where an operator operates the color printer 1; hereinbelow, the right side of the device in FIG. 1 will be referred to as the near side, and the left side will be referred to as the far side.

The color printer 1 comprises a photoreceptor drum 2, a rotary developing device 3, a laser unit 4, a toner container 5, a developing unit that comprises a toner supply device 6, an intermediate transfer belt 7, a secondary transfer roller 8, and a fusing device 9.

Photoreceptor Drum

An electrostatic latent image is formed on the surface of the photoreceptor drum 2, which is rotatably provided at substantially the center of the device, and its rotational axis is provided so that it extends in the transverse direction when viewed from the near side of the device, i.e., extends perpendicular to the paper surface in FIG. 1. A charging roller 10, which is for uniformly charging the surface of the photoreceptor drum 2, is provided to an upper part of the photoreceptor drum 2. In addition, a drum cleaning device 11, which is for cleaning, for example, residual toner or other adherends on the surface of the photoreceptor drum 2, is provided to the side of the photoreceptor drum 2.

Rotary Developing Device

The rotary developing device 3 is a device wherein the toner of each color develops the electrostatic latent image formed on the photoreceptor drum 2; further, the rotary developing device 3 is provided so that it is adjacent to the photoreceptor drum 2 and so that its center is at a height that is substantially the same as that of the center of the photoreceptor drum 2. The rotary developing device 3 comprises a rotary frame 15 and four developers 16, which correspond to the four color toners and are supported by the rotary frame 15. The rotary frame 15 is a cylindrical member that is rotatable about an axis parallel to the rotational axis of the photoreceptor drum 2, and is rotated by a drive mechanism (not shown) that includes a motor and a gear. In addition, the rotary frame 15 comprises four compartments, which are partitioned equally in the circumferential direction by partitions that extend radially outward from the center of the rotational axis, and the developers 16, corresponding to the four toner colors, i.e., yellow, cyan, magenta, and black, are disposed in the four compartments, respectively.

Figure 2:
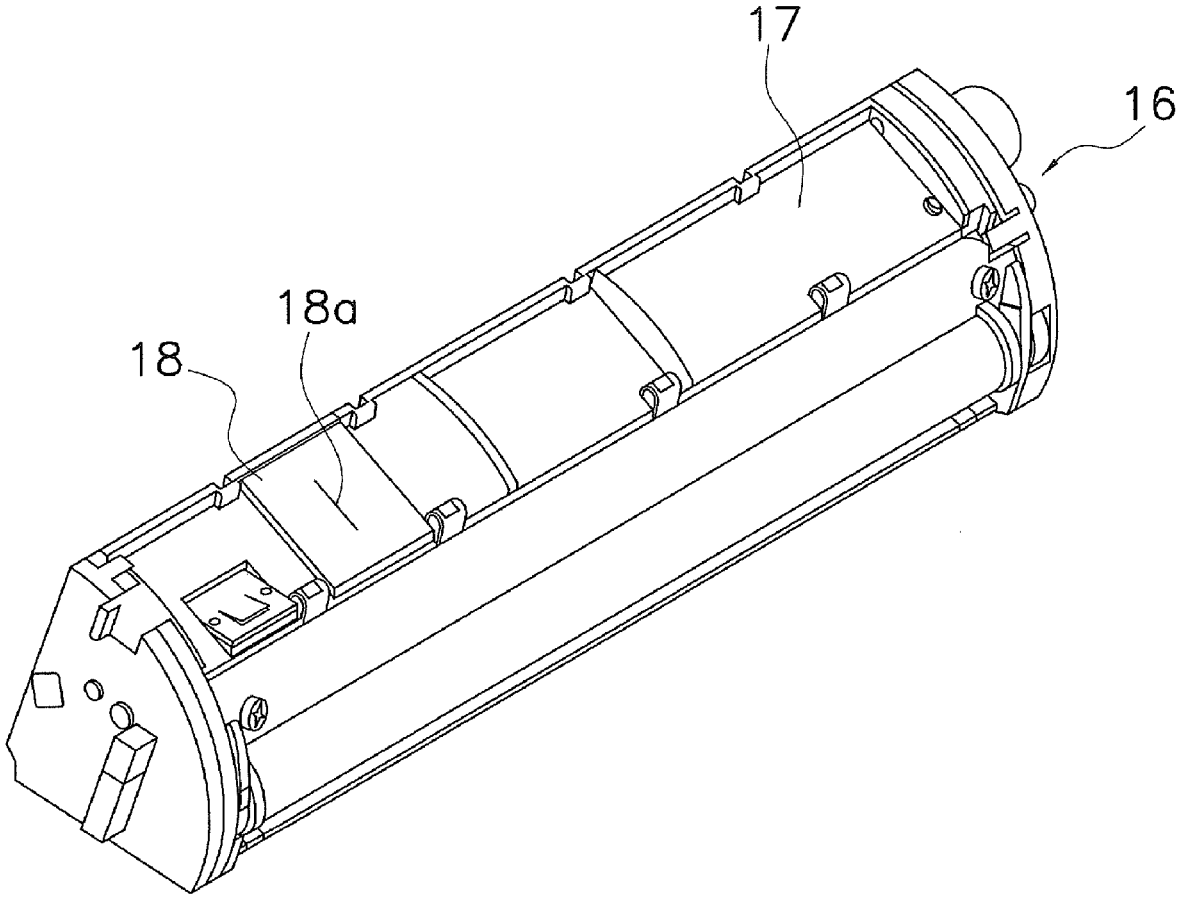
FIG. 2 is an external perspective view of a developer.

All of the developers 16 are constituted substantially the same, and each one is provided with, for example, a development roller, which is capable of being disposed opposing the photoreceptor drum 2, and an agitation roller for agitating the toner. One of the four developers 16 is shown in FIG. 2. In the present invention, the toner container 5 (discussed later) is provided so that it is separate and spaced apart from the developers 16. In addition, a toner supply unit 18 is provided on the outer circumferential side of a case 17 of the developer 16 in order to supply each of the toners the toner container 5 into the corresponding developer 16. The toner supply unit 18 is constituted so that an opening is formed in part of the case 17, and so that an elastic member, wherein a slit 18*a* is formed, is fixed to this opening.

Laser Unit

The laser unit 4 scans and exposes the photoreceptor drum 2 based on image data sent from, for example, the external computer, and is disposed above the photoreceptor drum 2 on the device far side of the rotational axis of the rotary developing device 3. More precisely, the front end (the end on the side from which the laser beam is emitted) of the laser unit 4 is positioned substantially directly above the rotational axis of the rotary developing device 3, the unit slopes downward toward its rear end side, and the rear end is disposed below the upper end of the rotary developing device 3. Furthermore, the internal constitution of the laser unit 4 is the same as that of a conventional laser unit and comprises, for example, a laser light source, a polygon mirror, and a polygon mirror drive motor. In addition, a reflecting mirror 20 is provided in front of the laser beam path of the laser unit 4. Accordingly, as shown by the chain line in FIG. 1, the laser beam emitted from the laser unit 4 is bent by the reflecting mirror 20, passes above the rotary developing device 3 on the device near side, and is irradiated to the surface of the photoreceptor drum 2.

Toner Container

The toner container 5 stores the toner to be supplied to each of the developers 16 of the rotary developing device 3, and is disposed above the photoreceptor drum 2 on the side (device near side) that opposes the laser unit 4. The toner container 5 comprises four containers, each of which are disposed lined up in the transverse direction (the paper surface in FIG. 1), that store the toner of each color, i.e., yellow, cyan, magenta, and black, respectively. In addition, the toner container 5 can be pulled out toward the device near side.

Toner Supply Device

The toner supply device 6 is for the purpose of supplying the toner of each color stored in the toner container 5 to the corresponding developer 16, and is disposed above the photoreceptor drum 2 in a space between the laser unit 4 and the toner container 5. As shown in FIG. 4 through FIG. 9, the toner supply device 6 comprises: four toner supply pipes 25, which are movable in the vertical direction; four transport pipes 26 that link portions of the toner container 5, which store each of the color toners, with the corresponding toner supply pipe 25; a drive mechanism 27 for vertically moving each of the toner supply pipes 25; a position holding mechanism 80 that restricts the movement of each of the toner supply pipes 25 when it is positioned at the toner supply position; and a retraction mechanism 90 that, if the electric power is cut off when one of the toner supply pipes 25 is at the toner supply position, positions that toner supply pipe 25 at a retraction position.

Toner Supply Pipe and Transport Pipe

Each toner supply pipe 25 is long in the vertical direction and inclined with its upper end on the device near side and its lower end on the device far side. In addition, the tip of each toner supply pipe 25 is tapered and, when moved downward, can pass through and be inserted inside the slit 18*a*, which is formed in the toner supply unit 18 of the developer 16. In addition, a spiral member 30 for transporting the toner is rotatably provided inside each toner supply pipe 25.

Figure 3:
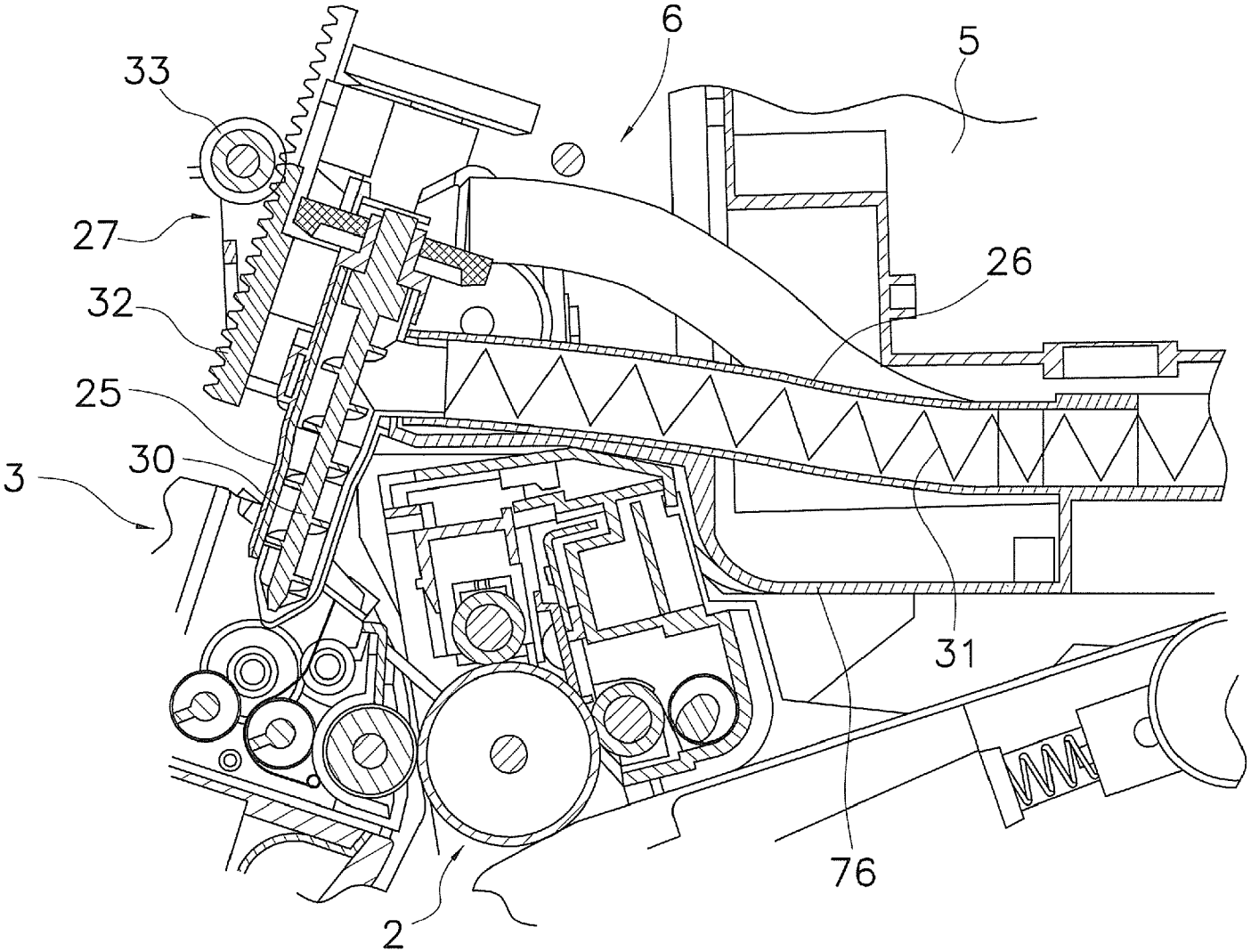
FIG. 3 is a detail cross sectional block diagram of a toner supply device.

FIG. 3 is a cross sectional view of the toner supply pipe 25 and the transport pipe 26; as shown in FIG. 3, the transport pipe 26 is flexible enough to move and thereby follow the vertical movement of the toner supply pipe 25. Furthermore, a coil spring 31, which is disposed inside of the transport pipe 26, is rotated by a drive mechanism (not shown), which transports the toner through the interior of the transport pipe 26 to the toner supply pipe 25 side.

Drive Mechanism

Figure 4:
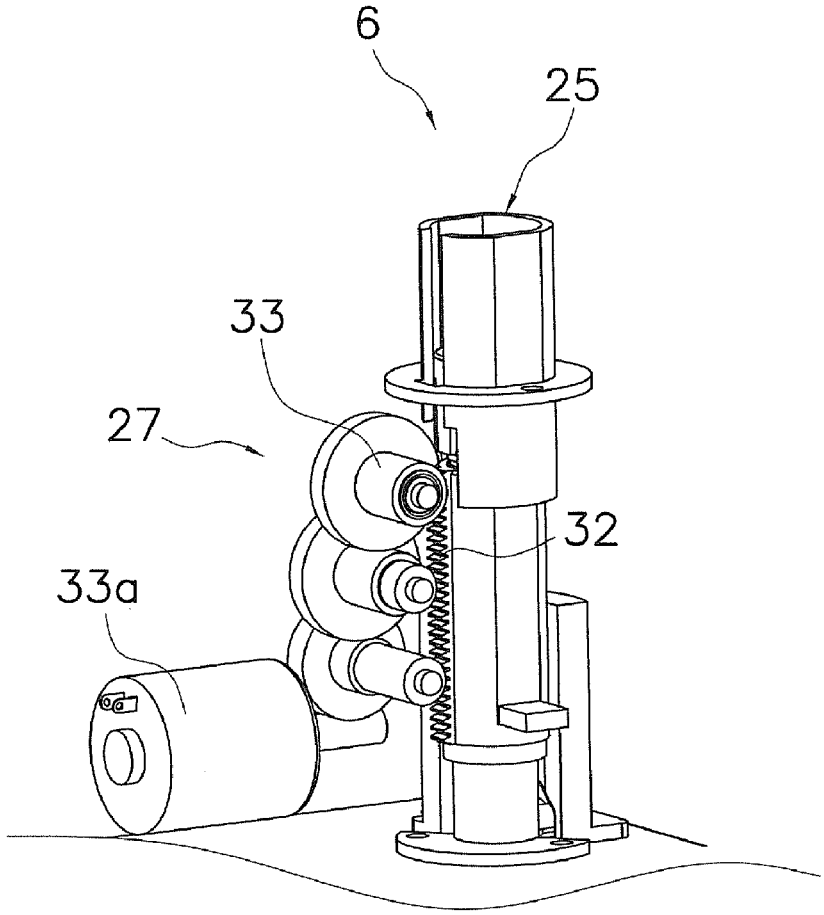
FIGS. 4(*a*) and 4(*b*) are external views of a drive unit mechanism of a toner supply pipe.
Figure 4:
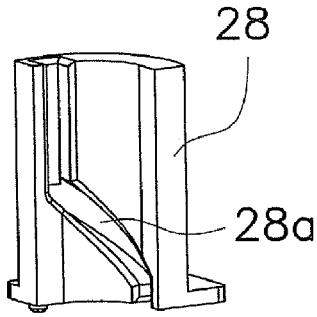

FIG. 4(*a*) shows an external view of the drive mechanism 27. The drive mechanism 27 comprises a motor 33*a*, a rack 32, which are provided on the outer circumference of the toner supply pipes 25 along the axial direction, and a pinion gear 33 that engages with the rack 32. The drive mechanism 27 makes it possible for each toner supply pipe 25 to be positioned at the upper retraction position (position shown by the solid line in FIG. 1) and the lower supply position (position shown by the chain double-dashed line in FIG. 1), wherein its tip is inserted into one of the developers 16. Furthermore, as shown in FIG. 8, holes 85 through which the toner supply pipes 25 can pass are formed in a frame 76 of the color printer 1 at positions that correspond to the toner supply pipes 25 of the four colors, and the toner supply pipes 25 move to the toner supply position through these holes 85.

As discussed previously, the laser beam of the laser unit 4 passes above the rotary developing device 3 on the device near side. Namely, the path of the laser beam and the movement path of each of the toner supply pipes 25 intersect; accordingly, the laser beam path is not blocked by the toner supply pipe 25 when it is at the retraction position, but is blocked when it is at the supply position.

Position Holding Mechanism

Figure 7:
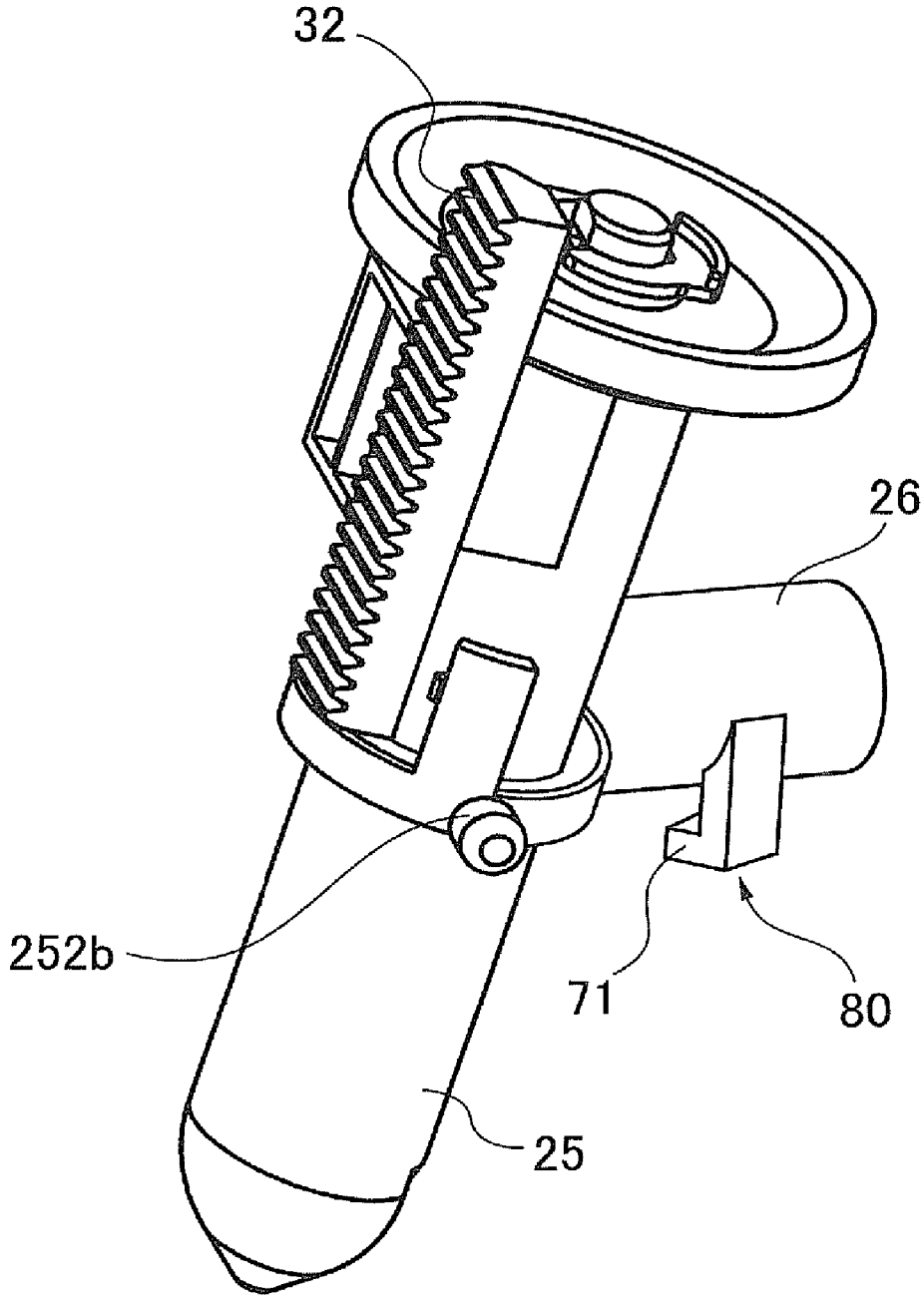
FIG. 7 is an external view of the toner supply pipe.
Figure 8:
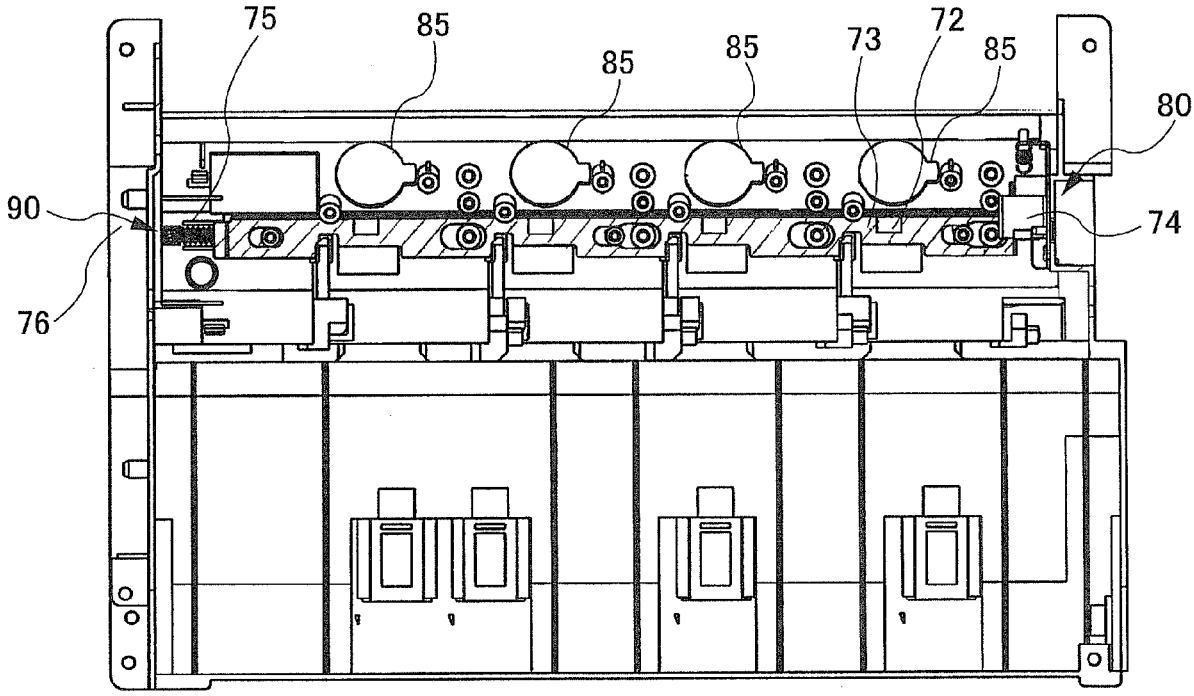
FIG. 8 is a block diagram of a position holding mechanism on the frame side of the color printer.
Figure 9:
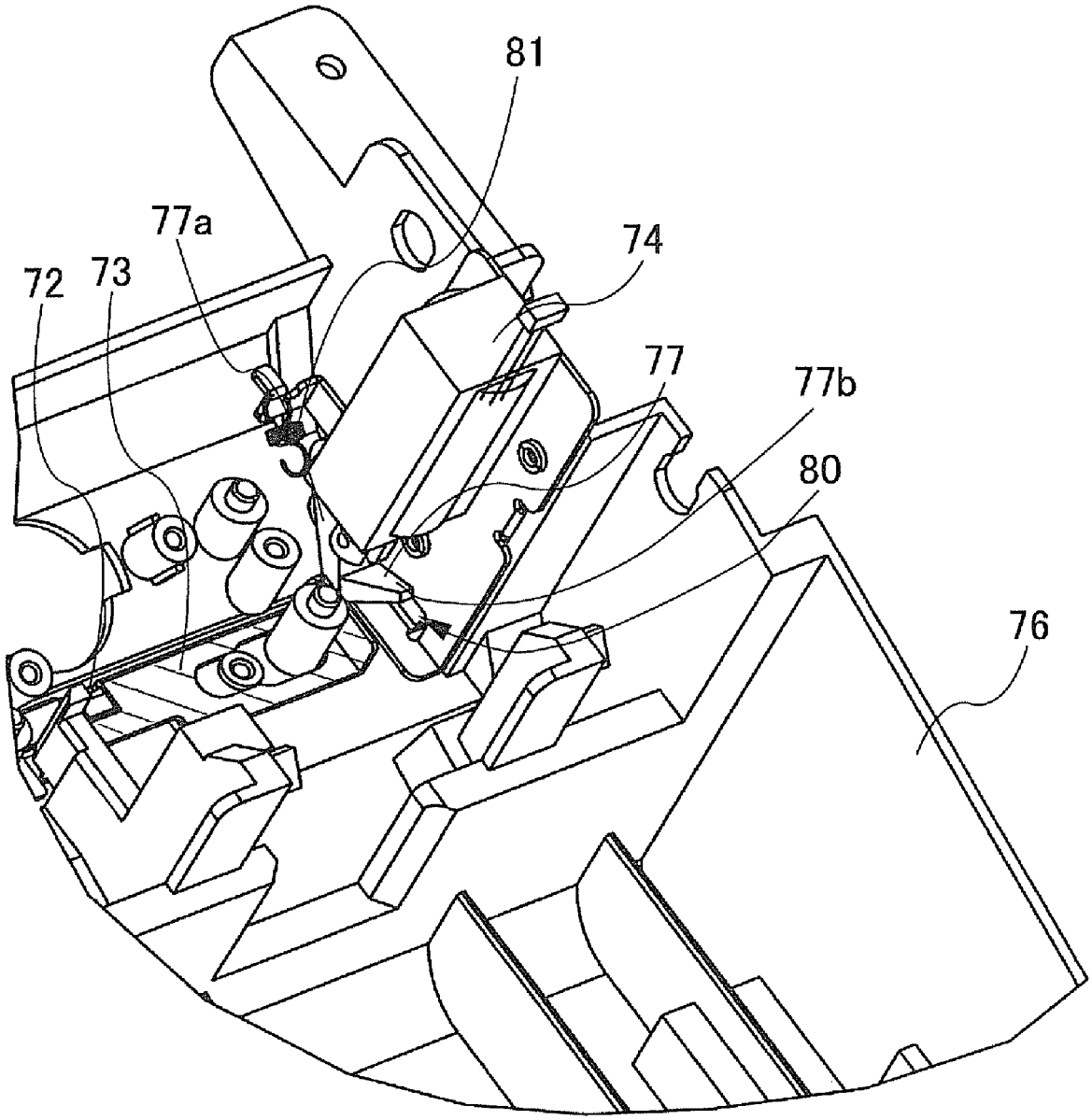
FIG. 9 is a diagram of a solenoid which is fixed to the frame of the color printer in an electric power transmitting state.
Figure 10:
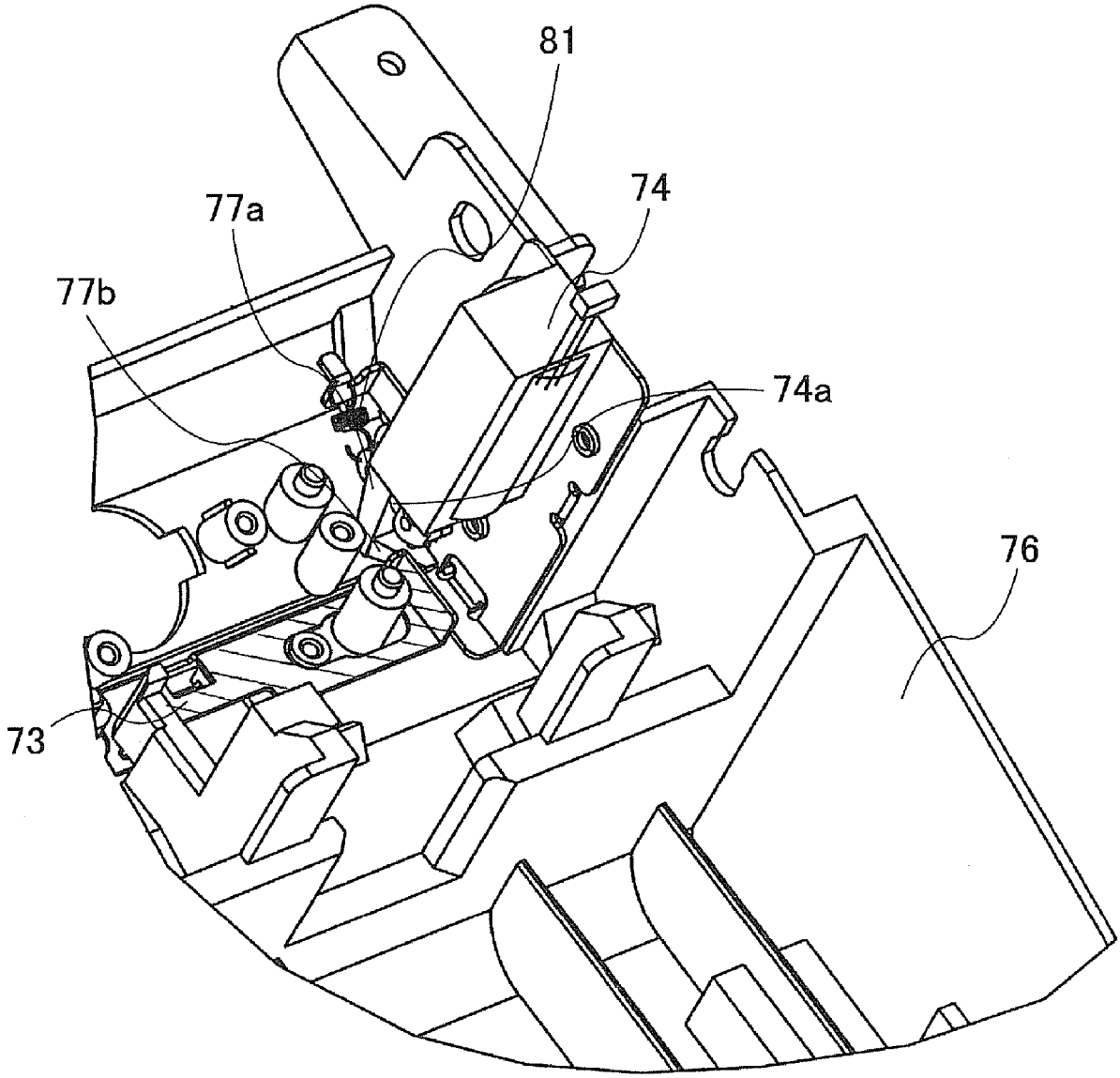
FIG. 10 is a diagram of the solenoid which is fixed to the frame of the color printer in an electric power cutoff state.

FIG. 7 shows one of the toner supply pipes 25 in a pulled out state, FIG. 8 is a partially exploded plan view of the toner supply device 6, FIG. 9 shows a holding state wherein a solenoid 74 is energized (discussed later), and FIG. 10 shows a retraction state wherein the solenoid 74 is de-energized (discussed later). As shown in these figures, the position holding mechanism 80 comprises latching projections 71 (first latching units), which are respectively fixed to the toner supply pipes 25, a latch plate 73 (second latching member), which is supported by the frame 76 of the color printer 1, as well as a lever 77 and the solenoid 74 that move the latch plate 73.

FIG. 7 shows one of the latching projections 71, which is an L shaped member that is fixed to the toner supply pipe 25 in the vicinity of the side of the transport pipe 26 and moves vertically along with the toner supply pipe 25. The latch plate 73 is a strip shaped plate, as shown by the diagonal lines in FIG. 8 through FIG. 10, extends in the direction in which the four toner supply pipes 25 are arrayed, and is supported freely movable in the longitudinal direction with respect to the frame 76. Furthermore, four square holes 72, through which the latching projections 71 of the toner supply pipes 25 can pass, are formed in the latch plate 73. Although discussed in detail later, after one of the latching projections 71 passes through one of the square holes 72 of the latch plate 73, the latch plate 73 moves in its longitudinal direction, and that latching projection 71 is thereby latched to the latch plate 73.

In addition, as shown in FIG. 8, the solenoid 74 is fixed to the frame 76 at one end side of the latch plate 73. Furthermore, at the other end side of the latch plate 73, a coil spring 75 is disposed between the other end of the latch plate 73 and the frame 76. The coil spring 75 continuously urges the latch plate 73 toward the solenoid 74 side (the right side in FIG. 8).

Figure 11:
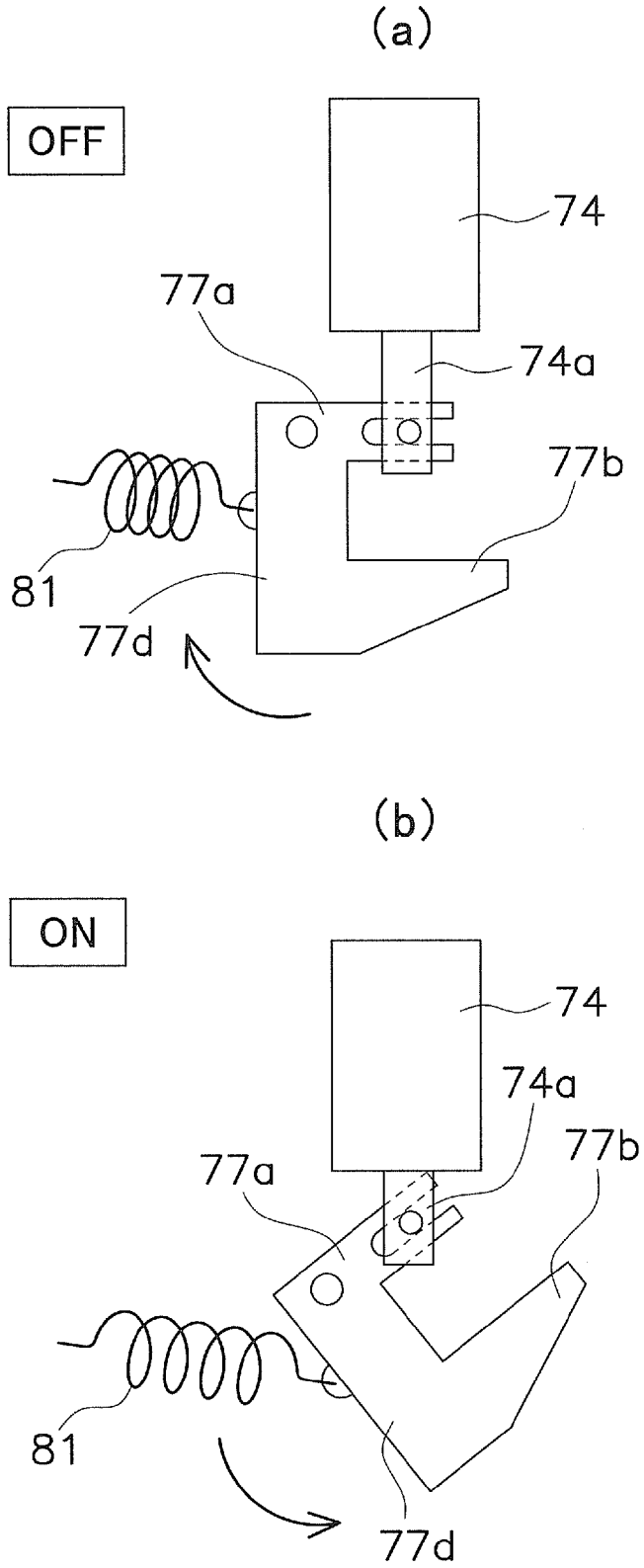
FIG. 11 is a diagram that shows the relationship between the solenoid, a lever, and a coil spring.
Figure 12:
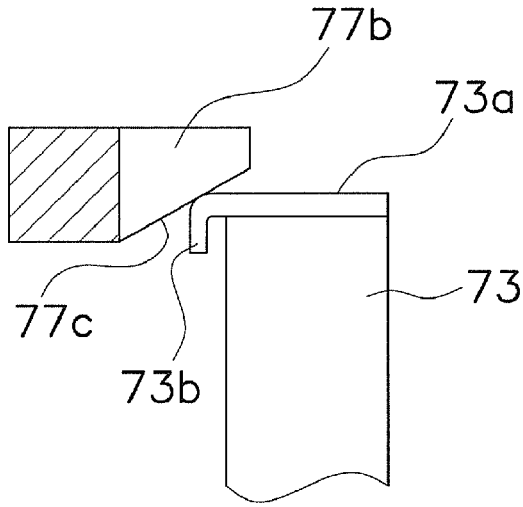
FIG. 12 shows an operation when the lever and a latch plate contact one another.
Figure 12:
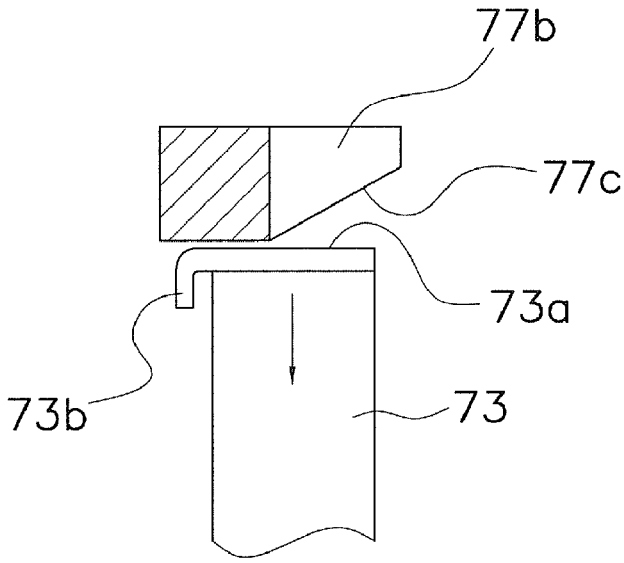

Here, as is apparent from FIG. 11, which schematically shows the actuation of the solenoid 74, the lever 77 is mounted to a tip of a plunger 74*a* of the solenoid 74. More specifically, the lever 77 is formed substantially C shaped, and is pivotably supported by the frame 76 with one end side of an upper part 77*a* as the fulcrum; furthermore, the tip of the plunger 74*a* of the solenoid 74 pivots on and slidably engages with the other end (tip) side of the upper part of the lever 77. In addition, FIG. 12 shows a section of the lever 77, viewed from above; as is apparent from FIG. 12, a lower part 77*b* of the lever 77 comprises a inclined surface 77*c* on its side part on the latch plate 73 side so that the lower part 77*b* is tapered, and the inclined surface 77*c* contacts the one end side of the latch plate 73. Furthermore, the portion where the latch plate 73 contacts the lever 77 comprises a portion 73*a*, which is bent upward, and a portion 73*b*, which is further bent from the bent portion 73*a* in a direction that extends in the direction along which the latch plate 73 extends. Thereby, as discussed later, the lever 77 and the latch plate 73 smoothly slide with respect to one another.

In addition, a coil spring 81 for urging the lever 77 in a direction away from the latch plate 73 is provided to an intermediate part 77*d* of the lever 77. Accordingly, when the solenoid 74 is not energized, the coil spring 81 continuously maintains the lever 77 in the attitude shown in FIG. 11(*a*).

Retraction Mechanism

Figure 6:
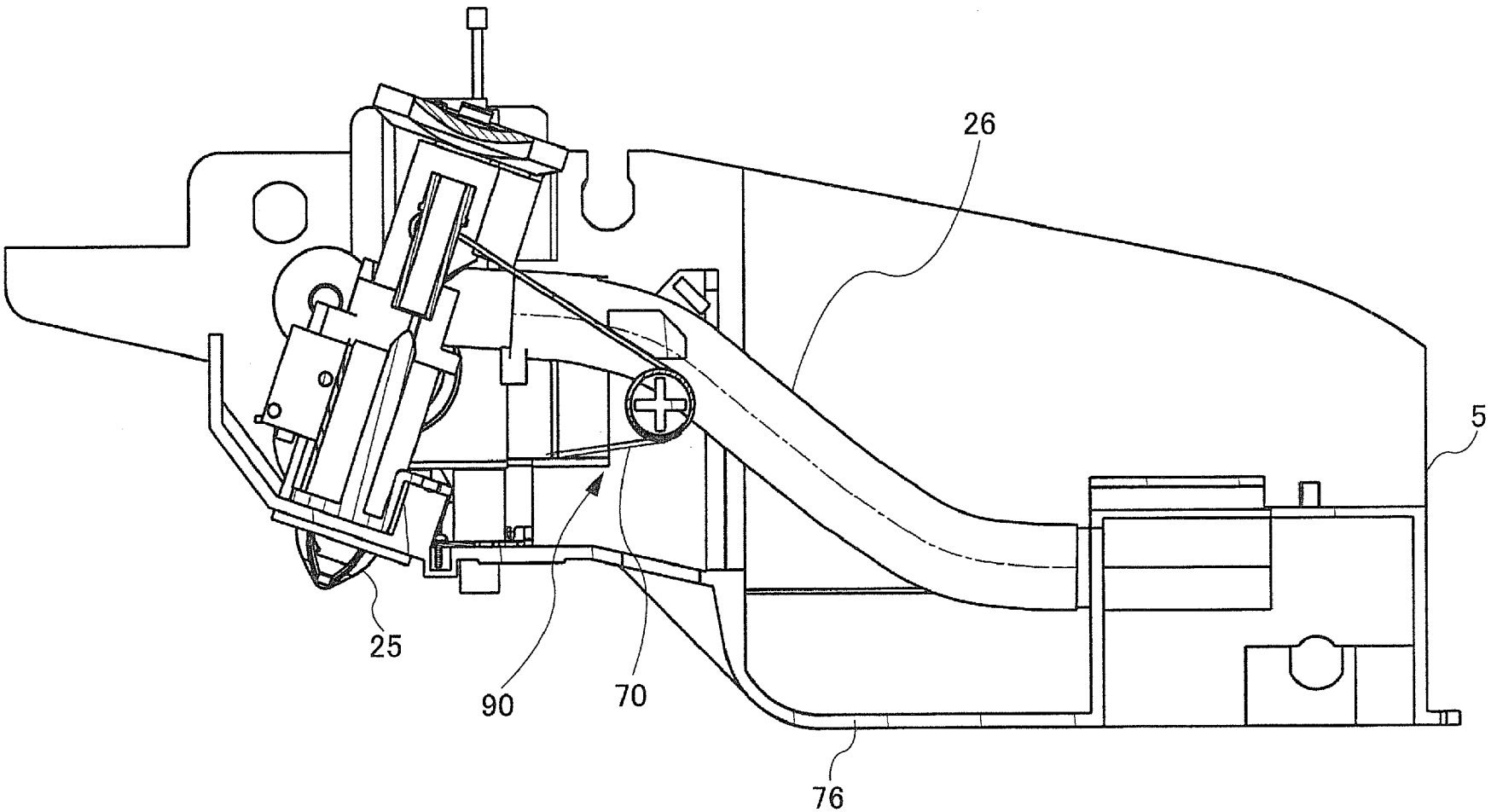
FIG. 6 is an external view of the toner supply pipe and a toner transport pipe.

The retraction mechanism 90 comprises the previously discussed coil spring 75 (refer to FIG. 8), which is disposed on the other end side of the latch plate 73, and a torsion spring 70, which is shown in FIG. 6. Furthermore, FIG. 6 is a cross sectional view of one of the toner supply pipes 25 at a position different from the one in FIG. 3.

The coil spring 75 is disposed between the other end of the latch plate 73 and the frame 76, as discussed earlier, and continuously urges the latch plate 73 toward one end side (the solenoid 74 side). In addition, the torsion spring 70 is mounted to the frame 76 via a mounting member (not shown); one end of the torsion spring 70 is latched to the toner supply pipe 25, and the other end is latched to the frame 76. This torsion spring 70 continuously urges the toner supply pipe 25 upward (to the retraction position side).

Shutter Mechanism

Figure 5:
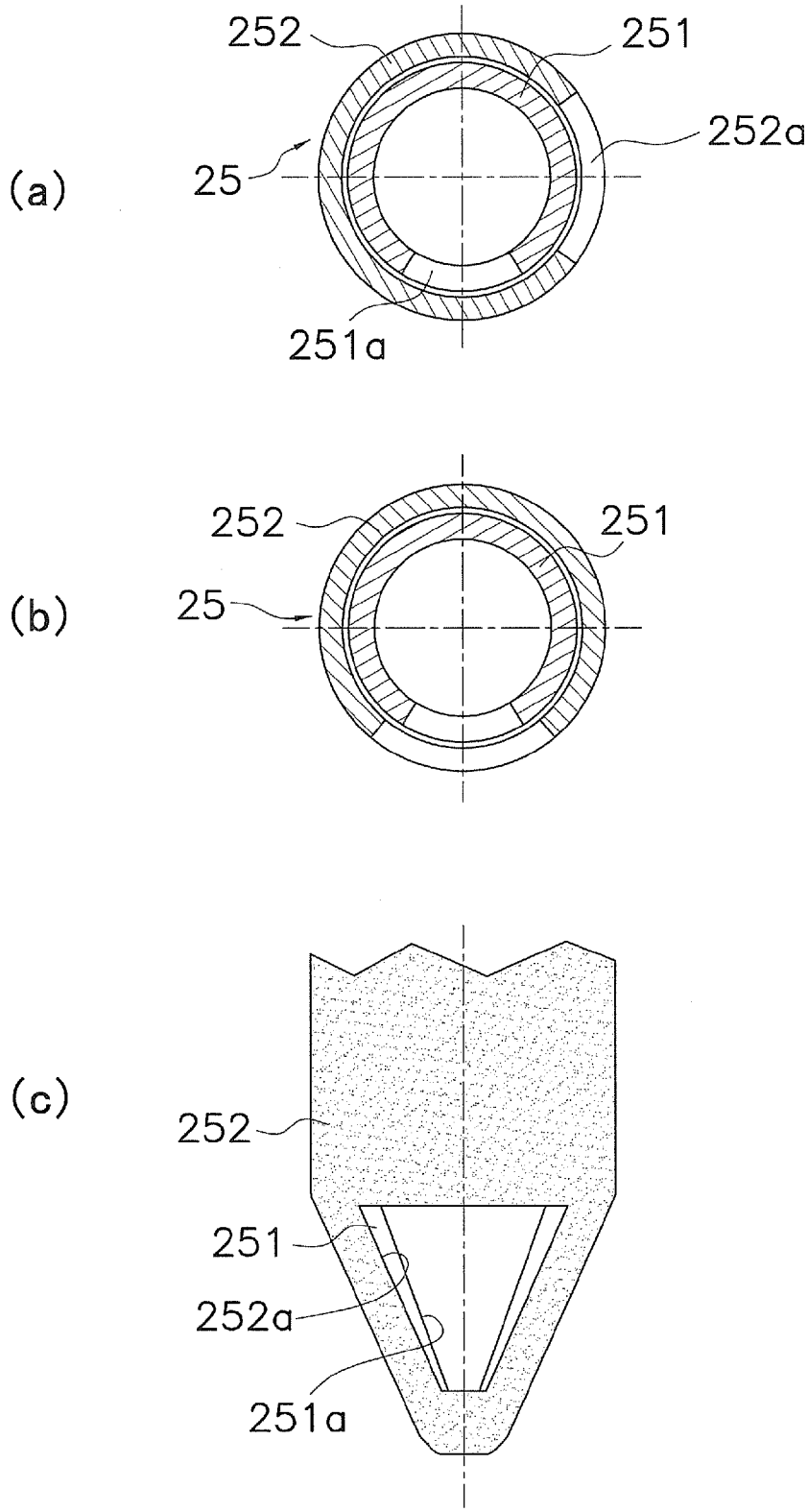
FIGS. 5(*a*), 5(*b*), and 5(*c*) are block diagrams of the tip of the toner supply pipe.

Furthermore, each of the toner supply pipes 25 comprises a shutter mechanism that opens only when that toner supply pipe 25 is positioned at the supply position. FIG. 5 shows an open-close mechanism at the tip of one of the toner supply pipes 25. Specifically, as shown in FIG. 5, the toner supply pipe 25 is a dual structure that comprises an inner cylinder 251 and an outer cylinder 252, and openings 251*a*, 252*a* are formed in part of the tips of these cylinders 251, 252 in the circumferential direction. Accordingly, the opening angle of the opening 252*a* of the outer cylinder 252 is larger than the opening angle of the opening 251*a* of the inner cylinder 251. In addition, a projection 252*b* is formed on the outer circumferential surface of the outer cylinder 252, as shown in FIG. 7, and engages with a rotary cam 28, wherein a helical guide 28*a* is formed, that is disposed further on the outer circumference of the outer cylinder 252. Furthermore, the rotary cam 28 in FIG. 4(*b*) is shown as an exploded view for the ease of understanding. Furthermore, when the toner supply pipe is at the upper retraction position, the opening 251*a* of the inner cylinder 251 and the opening 252*a* of the outer cylinder 252 are not aligned (shutter closed state), and the toner therefore does not leak out. However, when the toner supply pipe 25 moves downward, this outer cylinder 252 is rotated by the engagement of the projection 252*b* and the helical guide 28*a* of the rotary cam 28; further, when the tip of the toner supply pipe 25 is inserted into the developer 16 and is positioned at the supply position, the opening 251*a* of the inner cylinder 251 and the opening 252*a* of the outer cylinder 252 are aligned (the shutter open state), and the toner therein is supplied through the openings 251*a*, 252*a* into the developer 16.

Developing Unit

With the constitution described above, the developing unit of the present invention comprises the four developers (container main bodies) 16, the four toner supply pipes (toner supply members) 25, the drive mechanism 27, the position holding mechanism 80, and the retraction mechanism 90.

Intermediate Transfer Belt

The intermediate transfer belt 7 sequentially transfers the toner image for each color formed on the photoreceptor drum 2, and is disposed below the photoreceptor drum 2 and the toner container 5. The intermediate transfer belt 7 spans between a driver roller 35 and a follower roller 36, which are disposed opposing one another. In addition, the portion of the transfer belt 7 that opposes the photoreceptor drum 2 is constituted so that it contacts the photoreceptor drum 2 by a pair of primary transfer rollers 37*a*, 37*b*.

The arrangement of these constituent members will now be explained in greater detail. The driver roller 35 is positioned substantially directly below the portion where the photoreceptor drum 2 and the rotary developing device 3 make contact, and the center thereof is positioned below the lowest end of the rotary developing device 3. Furthermore, the driver roller 35 is driven by a drive unit (not shown), which includes a motor and a gear. The follower roller 36 is disposed proximate to the bottom of the toner container 5 on the device near side at a height that is substantially the same as that of the photoreceptor drum 2. A spring 38 urges the follower roller 36 away from the driver roller 35, which applies a predetermined tension to the intermediate belt 7. In addition, the primary transfer rollers 37*a*, 37*b* are provided below the photoreceptor drum 2 and are mutually proximate, which brings a predetermined area of the transfer belt 7 into contact with the photoreceptor drum 2.

Furthermore, a belt cleaning device 40, which cleans the transfer belt 7, is provided below the rotary developing device 3 on the device far side of the driver roller 35. The belt cleaning device 40 comprises: a fur brush 41, which is provided at a position opposing the driver roller 35, that slidably contacts the surface of the transfer belt 7; a cleaning roller 42, which is disposed above the fur brush 41 so that it contacts such; a blade 43, which is disposed so that its tip contacts the surface of the cleaning roller 42; and a recovery spiral 44, which is disposed below and in line with the blade 43.

In the cleaning device 40, the fur brush 41 brushes off adherends on the intermediate transfer belt 7, and the brushed-off adherends are then recovered by the cleaning roller 42. Furthermore, the adherends recovered on the cleaning roller 42 side are scraped off of the surface of the cleaning roller 42 by the blade 43, and then recovered in a recovery unit (not shown) by the recovery spiral 44.

Secondary Transfer Roller

The secondary transfer roller 8 is for the purpose of transferring the image, which was transferred to the intermediate transfer belt 7, to paper that is being transported, and is disposed below the driver roller 35 so that it opposes such. Furthermore, a bias voltage, which is for transferring the image to paper, is impressed upon the secondary transfer roller 8 by a voltage impressing means (not shown).

Fusing Device

The fusing device 9 fuses the toner, which was transferred onto the paper, and is disposed below the rotary developing device 3 and on the device far side. The fusing device 9 comprises a heating roller 9*a*, which has a built-in heater, and a pressure roller 9*b*, which contacts the heating roller 9*a* under pressure, and transports the paper while holding it interposed between both rollers.

Discharge Unit

With the printer 1, a discharge unit 50, which is for the purpose of stacking sheets of paper whereon images are formed, is formed on the upper surface of the device, i.e., above the laser unit 4, the toner supply device 6, and the toner container 5. The discharge unit 50 comprises: a curved surface, the lowest part of which is on the laser unit 4 side (the device far side), that becomes gradually higher toward the toner container 5 side (the device near side); and a flat part, which is continuous with the curved surface and is positioned above the toner container 5.

Paper Feeding Unit

A paper feeding unit 51, which is for the purpose of storing paper and feeding such, is provided at the bottom of the device. The paper feeding unit 51 comprises a paper feeding cassette 52, which comprises a stacking plate whereon the paper is stacked, a forward feed roller 53 for drawing out the paper on the stacking plate, and a multi-feed prevention mechanism 54, which consists of a pair of rollers that feed the paper to a transport path one sheet at a time. Furthermore, the paper feeding cassette 52 can be pulled out toward the device near side.

Transport Unit

The transport unit, which transports paper, is provided between the paper feeding unit 51 and the discharge unit 50. The transport unit comprises a first transport path 55, which extends from the paper feeding unit 51 to the secondary transfer roller 8, a second transport path 56, which extends from the secondary transfer roller 8 to the fusing device 9, and a third transport path 57, which extends from the fusing device 9 to the discharge unit 50. In addition, a branching claw 58 is provided at the exit of the fusing device 9, and a return transport path 59 for returning paper to the first transport path 55 is provided between the branching claw 58 and midway along the first transport path 55.

The first transport path 55 comprises a curved path 55*a* for reversing the transport direction of the paper fed from the paper feeding cassette 52 while transporting the paper upward, and a linear path 55*b*, which extends from the curved path 55*a* to the secondary transfer roller 8. These transport paths are formed by a guide plate and a pair of rollers that transport the paper while guiding it, and a sensor for detecting the paper is provided at a predetermined position. In addition, a pair of registration rollers 60 for controlling the transport timing of the paper is disposed in the linear path 55*b*.

The second transport path 56 is formed substantially linearly, and comprises a guide plate and a pair of rollers that transport the paper while guiding it. In addition, a sensor is for detecting the paper is provided at a predetermined position on the transport path.

The third transport path 57 comprises a longitudinal transport path that is formed on the downstream side of the branching claw 58 in the transport direction. Namely, the paper passes through the branching claw 58, is transported upward substantially vertically, and is then discharged to the discharge unit 50. The third transport path 57 likewise comprises a guide plate and a pair of rollers that transport the paper while guiding it.

The return transport path 59 branches downward from the third transport path 57 at the portion where the branching claw 58 is provided, passes below the fusing device 9, the second transport path 56, the secondary transfer roller 8, and the pair of registration rollers 60, proceeds upward, and then merges with the first transport path 55 on the upstream side of the pair of registration rollers 60 in the transport direction. Namely, the return transport path 59 is provided between the linear path 55*b* of the first transport path 55 and the paper feeding cassette 52 in the vertical direction, as well as between the second transport path 56 and the paper feeding cassette 52 in the vertical direction, and is for the purpose of returning the paper that passes through the fusing device 9 to the upstream side of the pair of registration rollers 60, which is disposed upstream of the secondary transfer roller 8. The return transport path 59 likewise comprises a guide plate and a pair of rollers that transport the paper while guiding it, and a paper detecting sensor is provided at a predetermined position.

Paper Feeding Tray

A paper feeding tray 65 is disposed below the toner container 5 and above the paper feeding cassette 52 so that it constitutes a side wall on the near side of the device. The lower end of the paper feeding tray 65 is pivotably (openably and closably) supported in the vicinity of the curved path 55*a* of the first transport path 55, and its upper end is capable of dropping toward the device near side about a pivot fulcrum 65*a*. In so doing, paper can be stacked on the paper feeding tray 65 with the paper feeding tray 65 in an open state, and this paper can be fed to the curved path 55*a* of the first transport path 55.

Image Forming Operation

The following is a brief explanation of the image forming operation. First, when the power supply to the color printer is turned on, various parameters are initialized and an initialization process is executed, such as setting the temperature of the fusing unit. Furthermore, when image data from, for example, the computer that is connected to the printer is input, and a print start instruction is issued, the image forming operation is executed as below. Furthermore, during the image forming operation, the toner supply pipes 25 are moved to the upper retraction position. Accordingly, the laser beam path is not blocked by any of the toner supply pipes 25.

First, the charging roller 10 charges the photoreceptor drum 2. Then, the laser unit 4 scans and exposes the photoreceptor drum 2 in accordance with the image data, which forms an electrostatic latent image on the photoreceptor drum 2. Next, the rotary developing device 3 rotates, which brings the developer 16 of the corresponding color to a position opposing the photoreceptor drum 2. In this state, the electrostatic latent image of the photoreceptor drum 2 is developed by the toner of the corresponding color. The developed image is transferred to the intermediate transfer belt 7. By performing the above operation successively and repetitively for each color, a full color image is formed on the intermediate transfer belt 7. Furthermore, the residual toner and the like on the photoreceptor drum 2 is cleaned by the drum cleaning device 11 and discarded to a waste toner container (not shown).

Meanwhile, at the paper feeding unit 51, one sheet of paper is drawn out from the paper feeding cassette 52 by the forward feed roller 53 and the multi-feed prevention mechanism 54, and is transported to the pair of registration rollers 60 via the first transport path 55. Subsequently, the paper is transported from the pair of registration rollers 60 in accordance with the timing of the formation of the image on the intermediate transfer belt 7, and is guided to the secondary transfer roller 8. The secondary transfer roller 8 contacts the intermediate transfer belt 7 and a transfer bias impressed upon the secondary transfer roller 8 transfers the full color image formed on the intermediate transfer belt 7 to the paper. This sheet of paper is guided to the fusing device 9 via the second transport path 56, and the image is fused to the paper by the application of heat and pressure by the fusing device 9. Furthermore, in the case of single sided printing, the paper is guided to the third transport path 57 via the branching claw 58 and discharged to the discharge unit 50.

In addition, in the case of double sided printing, the paper that passes through the fusing device 9 is guided by the branching claw 58 to the return transport path 59 side, and returns to the first transport path 55. The paper that returns to the first transport path 55 is temporarily stopped by the pair of registration rollers 60. Furthermore, the image on the rear surface side is formed on the intermediate transfer belt 7 by an operation the same as the one discussed earlier and, in accordance with that timing, the paper that was standing by at the pair of registration rollers 60 is sent to the secondary transfer roller 8 side. Subsequently, the operation the same as the one mentioned earlier is executed, and the paper is guided to the third transport path 57 side via the branching claw 58, and then discharged to the discharge unit 50.

Toner Supply Operation

When supplying toner to one of the developers 16, the rotary developing device 3 is rotated and the developer 16 to be supplied with toner is positioned at the supply position, as shown in FIG. 1. In this state, the rotation of the rotary developing device 3 is locked. Next, the toner supply pipe 25 of the toner color to be supplied is positioned at the supply position by moving it downward. Namely, driving the motor 33*a* rotates the pinion gear 33 via a gear train, which transmits the motive power to the rack 32 and moves the toner supply pipe 25 downward. In addition, the toner from the toner container 5 is supplied to the toner supply pipe 25 side by rotating the coil spring 31 inside the transport pipe 26. Attendant with the movement of this toner to the lower part of the toner supply pipe 25 of the color to be supplied, the outer cylinder 252, which constitutes the toner supply pipe 25, rotates with respect to the inner cylinder 251, and, at the point in time when the tip of the toner supply pipe 25 is inserted in the developer 16, the opening 252*a* of the outer cylinder 252 and the opening 251*a* of the inner cylinder 251 are aligned. Namely, the shutter mechanism opens.

Figure 13:
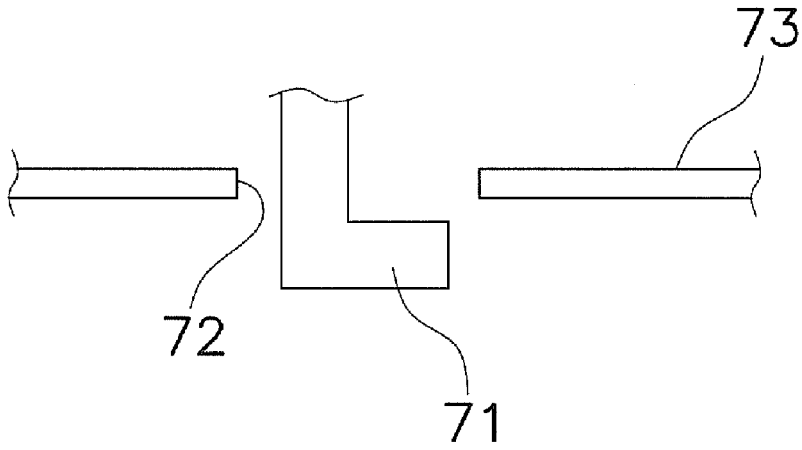
FIG. 13 shows an operation that latches a latching projection and the latch plate to one another.
Figure 13:
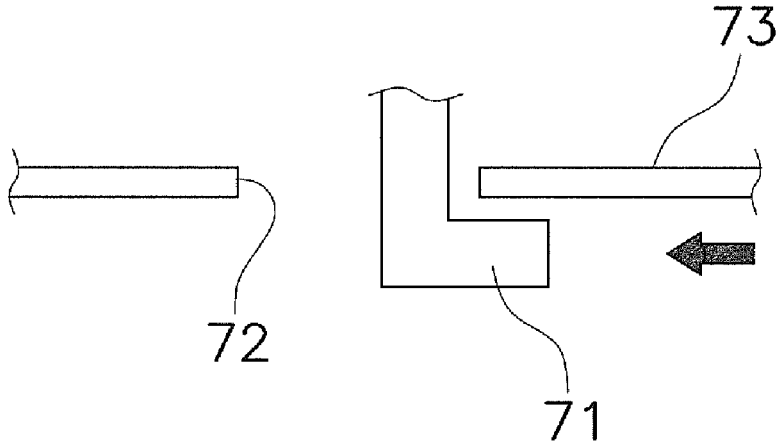

At this point, when the toner supply pipe 25 descends as described above, the solenoid 74 is not energized. Accordingly, the magnetic attraction of the coil of the solenoid 74 does not act upon the plunger 74*a*, and the coil spring 81 pivots the lever 77 clockwise about its fulcrum, and the lever 77 stops in a state wherein the plunger 74*a* is maximally projecting (the state shown in FIG. 11(*a*)). In this state, the latch plate 73 is urged by the coil spring 75 to the solenoid 74 side, and contacts the lever 77 in the state shown in FIG. 12(*a*). In this case, the latching projection 71, which descends along with the toner supply pipe 25, passes through the square hole 72 of the latch plate 73. This state is schematically shown in FIG. 13(*a*).

Furthermore, when the toner supply pipe 25 is positioned at the toner supply position, the solenoid 74 is energized, which retracts the plunger 74*a*. In so doing, the lever 77, which is in an attitude as shown in FIG. 11(*a*), pivots counterclockwise about its fulcrum, and transitions to the attitude shown in FIG. 11(*b*). In addition, attendant with the pivoting of the lever 77, the positional relationship between the lever 77 and the latch plate 73 transitions from the state shown in FIG. 12(*a*) to the state shown in FIG. 12(*b*). Namely, the pivoting of the lever 77 pushes the latch plate 73 away from the solenoid 74 while the inclined surface 77*c* of the lever 77 contacts the bent parts 73*b*, 73*a* of the latch plate 73. Consequently, the latch plate 73 moves to the coil spring 75 side against the urging force thereof. This state is schematically shown in FIG. 13(*b*). At this time, the latch plate 73 latches with the latching projection 71, which prohibits the upward movement of the toner supply pipe 25. Accordingly, in this state, the toner supply pipe 25 is maintained at the toner supply position even if the motor 33*a* of the drive mechanism 27 is turned off. Furthermore, because the bent parts 73*a*, 73*b* are formed at the portion where the latch plate 73 contacts the lever 77, both slide smoothly with respect to one another.

Furthermore, when the toner supply pipe 25 is positioned at the supply position, the laser beam path, which extends from the laser unit 4 to the photoreceptor drum 2, is blocked by that toner supply pipe 25. However, this is not a problem because the supply operation of the toner by the toner supply pipe 25 is not executed at the same time as the image forming operation.

When the supply of toner ends, the solenoid 74 is deenergized. In so doing, the plunger 74*a* transitions to a free state, and the lever 77 pivots clockwise by the urging force of the coil spring 81, and transitions to the state shown in FIG. 11(*a*). Thereby, the lever 77 moves away from the latch plate 73, thereby moving the latch plate 73 to the solenoid 74 side via the coil spring 75, which is the reverse of the previous case, and transitions to the state shown in FIG. 12(*a*). In this case, as shown in FIG. 13(*a*), the latching projection 71 of the toner supply pipe 25 and the square hole 72 of the latch plate 73 are aligned, and the toner supply pipe 25 transitions to a state wherein the upward movement is permitted.

In this state, the motor 33*a* rotates in reverse, which rotates the pinion gear 33 in reverse. Thereby, the toner supply pipe 25, to which the rack 32 is fixed, moves upward. At this time, the outer cylinder 252 rotates in the direction that is the reverse of that mentioned earlier, the opening 251*a* of the inner cylinder 251 and the opening 252*a* of the outer cylinder 252 are positionally deviated, and the opening is thereby closed. Namely, the shutter is closed. In addition, at the toner supply unit 18 provided to side of the developer 16, the slit 18*a* is closed by elastic force even if the toner supply pipe 25 slips out of it. Accordingly, it is possible to prevent the scattering of the toner from the toner supply pipe 25 and the developer 16 to the inside of the machine.

When the Power is Cut Off

If the power has transitioned to the electric power cutoff state when one of the toner supply pipes 25 is positioned at the toner supply position, then the plunger 74*a* transitions to the free state because the power to the solenoid 74 is also cut off. In this case, the same as the case wherein the toner supply ends as discussed earlier, the lever 77 transitions to the state shown in FIG. 11(*a*) by the urging of the coil spring 81, and the latch plate 73 moves to the solenoid 74 side and transitions to the state shown in FIG. 12(*a*). In addition, during the electric power cutoff state, it is impossible for the drive mechanism 27 to move the toner supply pipe 25 upward to the retraction position, but the toner supply pipe 25 moves to the retraction position by the urging of the torsion spring 70, which is fixed to the frame 76. At this time, the outer cylinder 252 rotates in a direction that is the reverse of that mentioned above, the opening 251*a* of the inner cylinder 251 and the opening 252*a* of the outer cylinder 252 are positionally deviated, and the opening closes. Namely, the shutter transitions to the closed state.

With the present embodiment, even if the power transitions to the electric power cutoff state when one of the toner supply pipes 25 is positioned at the toner supply position, the rotary developing device 3 rotates in that state, and it is therefore possible to prevent breakage of the toner supply pipe 25 and the corresponding developer 16. In addition, the state wherein the toner supply pipe 25 is inserted into the developer 16 continues for a long time period, which hardens the slit 18*a* of the elastic member provided to the toner supply unit 18, and it is therefore possible to prevent leakage of the toner due to the rotation of the rotary developing device 3 in a state wherein the slit 18*a* is hardened.

Modification of the First Embodiment

With the abovementioned embodiment, the strip shaped latch plate 73, which comprises the plurality of square holes 72, is used as the second latching member, but the present invention is not limited thereto; for example, a projection that is capable of latching with one of the latching projections 71 may be provided to a columnar member, that latching projection 71 and the projection may latch by the rotation of this columnar member, and the upward movement of the corresponding toner supply pipe 25 in the vertical direction may thereby be restricted. In addition, with the abovementioned embodiment, the torsion spring 70 is used to move the toner supply pipe 25 to the retraction position in the electric power cutoff state, but the present invention is not limited thereto; for example, a coil spring may be used.

Second Embodiment

Here, in the toner supply device 6 of the abovementioned embodiment, the spiral member 30 is rotatably provided inside each of the toner supply pipes 25; however, if drive mechanisms for rotating the spiral members 30 are provided corresponding to toner supply devices 6, one for each color, then the structure becomes complicated, the number of parts increase, and reducing size becomes problematic.

Accordingly, the following explains an embodiment wherein a spiral member of each of the plurality (herein, four) of toner supply devices is driven by one drive mechanism. Furthermore, the following explains only the toner supply pipes and the mechanism for driving the spiral members therein, but other aspects of the constitution are the same as in the first embodiment, and the explanations thereof are therefore omitted. In addition, elements that are the same as those in the first embodiment are assigned the same symbol.

Toner Supply Pipe

Figure 14:
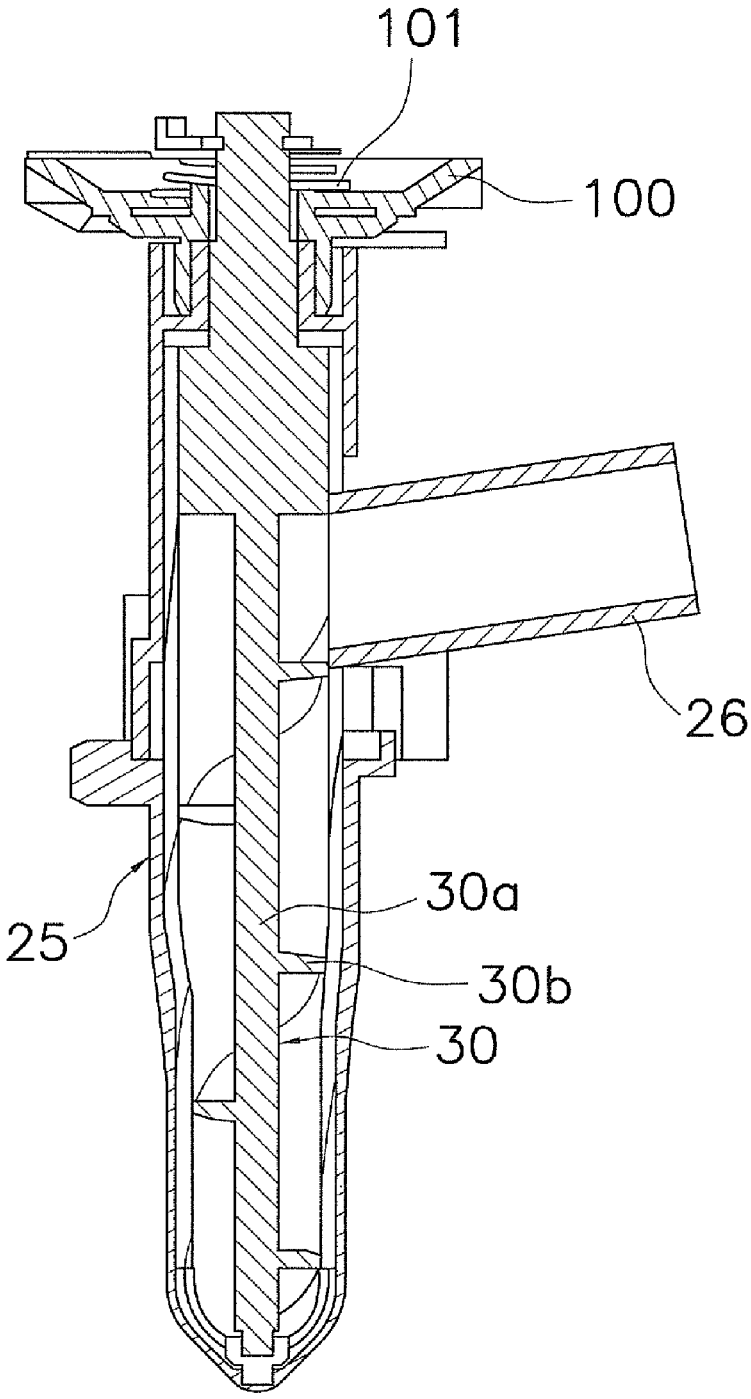
FIG. 14 is a cross sectional block diagram of the toner supply pipe according to a second embodiment.

FIG. 14 shows a cross section of a toner supply pipe 25 according to the second embodiment. As shown in the figure, the tip of the toner supply pipe 25 is tapered, the same as mentioned above, and can pass through the slit formed in the toner supply unit of the developer 16 and be inserted therein when the tip moves downward (to the toner supply position). The spiral member 30 is disposed inside the toner supply pipe 25. A first bevel gear 100 is disposed above the spiral member 30, and a spring 101 is disposed between the first bevel gear 100 and the upper end of the spiral member 30.

The spiral member 30 is for transporting toner to the lower end side opening for supplying the toner, and comprises a rotary shaft 30*a*, which is long in the vertical direction, and a transport piece 30*b*, which is helically formed at the outer circumference of the rotary shaft 30*a*. In addition, the first bevel gear 100 is a circular truncated cone member, and teeth are formed in its lower side inclined surface. The spring 101 is a member for urging the first bevel gear 100 downward.

Actuation Mechanism

Figure 15:
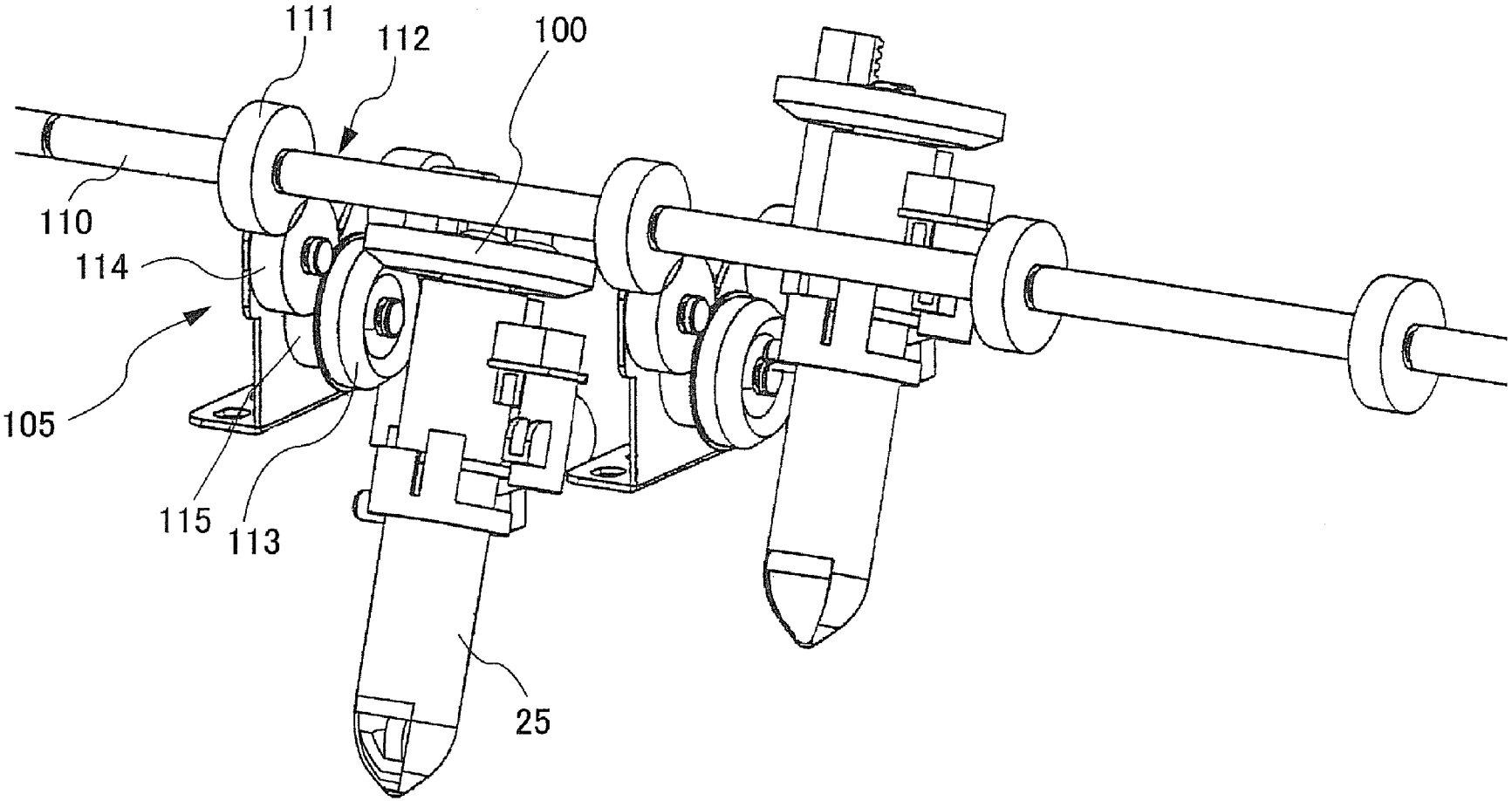
FIG. 15 is an external view of an actuation mechanism of a spiral member.

An actuation mechanism 105 is provided for driving the spiral member 30 when one of the toner supply pipes 25 is positioned at the toner supply position. FIG. 15 shows the details of the actuation mechanism 105. In FIG. 15, only two toner supply devices are shown in order to show the toner supply position and the retraction position.

The actuation mechanism 105 comprises one motor (not shown) and one drive shaft 110, as well as drive gears 111, gear trains 112, and second bevel gears 113 that correspond in number to the toner supply devices 6. The drive shaft 110 is constituted so that the drive power of the motor is applied from one end, and extends parallel to the rotational axis of the rotary frame 15. Each drive gear 111 is fixed to the drive shaft 110 at a position corresponding to its respective toner supply device 6. Each gear train 112 is for the purpose of transmitting the drive power of the motor, which transmitted to the corresponding drive gear 111, to the corresponding second bevel gear 113, and comprises a first gear 114 that meshes with the drive gear 111, and a second gear 115, which is fixed coaxially with the second bevel gear 113, that meshes with the first gear 114. In addition, each second bevel gear 113 is disposed so that its axis intersects with the axis of the corresponding first bevel gear 100, and is provided so that it meshes with the first bevel gear 100 when the corresponding toner supply pipe 25 is positioned at the toner supply position.

Toner Supply Operation

When supplying toner, one of the toner supply pipes 25 is moved downward and positioned at the supply position. Namely, referring to FIG. 4, if the motor 33*a* is driven, then the pinion gear 33 rotates via the gear train, and the toner supply pipe 25, to which the rack 32 is fixed, thereby moves to the lower toner supply position. If the first bevel gear 100 and the second bevel gear 113 are in a state wherein they can mesh when the toner supply pipe 25 moves downward, then the first bevel gear 100 and the second bevel gear 113 mesh, which transmits the drive power of the motor to the spiral member 30 via the drive gear 111, the gear train 112, the second bevel gear 113, and the first bevel gear 100.

Meanwhile, if the first bevel gear 100 and the second bevel gear 113 are in a state wherein they do not smoothly mesh when the toner supply pipe 25 moves downward, i.e., if the teeth of the first bevel gear 100 and the teeth of the second bevel gear 113 are in a positional relationship wherein they knock into one another, then the first bevel gear 100 is pushed upward against the urging force of the spring 101. Subsequently, when the drive power of the motor rotates the second bevel gear 113, and the teeth of the first bevel gear 100 and the teeth of the second bevel gear 113 transition to a state wherein they properly mesh with one another, the urging force of the spring 101 pushes the first bevel gear 100 to the second bevel gear 113 side.

As described above, it is possible to transmit the drive power of the motor to the spiral member 30 when the toner supply pipe 25 moves to the toner supply position in either the case wherein the first bevel gear 100 and the second bevel gear 113 can smoothly mesh as well as in the case where they cannot.

The remaining aspects of the toner supply operation are the same as in the first embodiment.

With the present embodiment, it is possible to drive the spiral members 30 of the toner supply pipes 25 provided to the four toner supply devices with one drive mechanism, which reduces costs and simplifies the structure compared with the case wherein a drive mechanism is provided for driving each spiral member 30. Furthermore, it is possible to make the mechanism more compact because the number of motors and the number of parts can be reduced. In addition, because the first bevel gear 100 and the second bevel gear 113 mesh together as bevel gears, it is therefore possible for the tip of one of the toner supply pipes 25 to enter the corresponding developer 16, and for the drive power to be transmitted even if the inclination of the toner supply pipe 25 deviates.

Modification of the Second Embodiment

In the abovementioned embodiment, bevel gears are used as the components that link the spiral member and the drive side mechanism, but the present invention is not limited thereto, and disc shaped friction members may be used instead.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing unit, comprising:

a plurality of container main bodies, each of which comprises a development roller;

a plurality of toner supply members, each of which comprises a toner supply port and supplies toner to each of the plurality of container main bodies;

a drive mechanism configured to move the toner supply members so that each toner supply member can be positioned at a toner supply position at which the toner supply port is positioned inside the container main body, and at a retraction position at which the toner supply member is positioned outside the container main body;

a position holding mechanism configured to restrict the movement of each toner supply member when the toner supply member is positioned at the toner supply position; and a retraction mechanism configured to release the toner supply member from the position holding mechanism and position the toner supply member at the retraction position when an electric power is cut off when the toner supply member is positioned at the toner supply position.

2. A developing unit as recited in claim 1, wherein the position holding mechanism comprises a first latching unit fixed to each toner supply members, and a second latching member configured to latch to the first latching unit.

3. A developing unit as recited in claim 1, wherein the retraction mechanism comprises a second latching member drive device configured to move the second latching member so that the latching of the first latching unit and the second latching member is released, and an urging member configured to urge the toner supply member to the retraction position.

4. A developing unit as recited in claim 2, wherein the position holding mechanism further comprises a member configured to move the second latching member so that the first latching unit latches to the second latching member.

5. A developing unit as recited in claim 3, wherein the second latching member drive device is an urging member.

6. A developing unit as recited in claim 1, wherein each of the plurality of toner supply members comprises a toner transport member configured to transport the toner to the toner supply port;

and further comprising:

an actuation mechanism comprising a drive source configured to actuate the toner transport member of the toner supply member when the toner supply member is positioned at the toner supply position.

7. A developing unit as recited in claim 6, wherein the actuation mechanism further comprises:

a driven member mounted to the toner transport member; and a drive member that transmits drive power to the driven member when the toner supply member is positioned at the toner supply position.

8. A developing unit as recited in claim 6, wherein the driven member is a first disc shaped member; and the drive member is a second disc shaped member that engages with the first disc shaped member.

9. A developing unit as recited in claim 8, wherein the first disc shaped member is a first bevel gear; and the second disc shaped member is a second bevel gear.

10. A developing unit as recited in claim 9, wherein the first bevel gear is supported by the toner supply member so as to be freely movable in the direction of movement thereof; and the actuation mechanism further comprises an urging member configured to urge the first bevel gear toward the second bevel gear.

11. A developing unit as recited in claim 1, further comprising:

a shutter mechanism configured to set the toner supply port to an open state when the toner supply member is positioned at the toner supply position, and set the toner supply port to a closed state when the toner supply member is positioned at the retraction position.

12. A developing unit as recited in claim 1, wherein the container main body comprises an elastic member having a slit formed therein through which the toner supply member passes when the toner supply member moves to the retraction position and the toner supply position.

* * * * *